United States Patent [19]

Meier

[11] Patent Number: 4,809,250

[45] Date of Patent: Feb. 28, 1989

[54] REVERSER MECHANISM FOR AN AUTOMATIC WINDING ARRANGEMENT

[75] Inventor: Willy Meier, Fontaines, Switzerland

[73] Assignee: Fabrique Ebel, Societe Anonyme, Switzerland

[21] Appl. No.: 150,119

[22] Filed: Jan. 29, 1988

[51] Int. Cl.[4] ..... G04B 5/02

[52] U.S. Cl. ..... 368/208

[58] Field of Search ..... 368/208, 207

[56] References Cited

U.S. PATENT DOCUMENTS

| | | | |
|---|---|---|---|
| 2,030,980 | 2/1936 | Gabriel | 368/208 |
| 2,807,133 | 9/1957 | Maire | 368/208 |
| 2,874,532 | 2/1959 | Baier | 368/208 |
| 3,019,595 | 2/1962 | Murrle | 368/208 |
| 3,067,571 | 12/1962 | Gigandet | 368/208 |
| 3,952,498 | 4/1976 | Saito et al. | 368/208 |

FOREIGN PATENT DOCUMENTS

| | | |
|---|---|---|
| 1063393 | 5/1954 | France . |
| 1114120 | 4/1956 | France . |
| 344370 | 9/1959 | Switzerland . |
| 348922 | 1/1970 | Switzerland . |

*Primary Examiner*—Bernard Roskoski

*Attorney, Agent, or Firm*—Pollock, Vande Sande & Priddy

[57] ABSTRACT

In this reverser mechanism the winding wheel is assembled on a common axis with two ratchet wheels each assigned to one of the pivoting direction of the oscillating mass.

The winding wheel is pierced by rivets which bear respectively a pawl and a spring. The spring which is thus mounted on a pivot means of a pawl cooperating with one of the ratchet wheels loads the pawl which cooperates with the other ratchet wheel.

The mechanism is for use with timepieces having automatic winding of the mainspring.

5 Claims, 2 Drawing Sheets

4
1c
17
15c
14c
7
6
9
2
14a
10
15a
5
17
3b
1
11
7
8
3a
17
16
20
13
20
18
19
16
17
20
21
13
1
1c
12b
1a
12a
12b
12a
12
F1
F2
4
1
7
10
11
F2
F1
F3
8
I

REVERSER MECHANISM FOR AN AUTOMATIC WINDING ARRANGEMENT

TECHNICAL FIELD

This invention concerns automatic winding arrangements for timepieces by means of an oscillating mass.

More precisely, the invention concerns a reverser mechanism for such an automatic winding arrangement.

BACKGROUND OF THE INVENTION

In standard arrangements, the automatic winding arrangement for a timepiece is assured by an assembly comprising a pivoting oscillating mass which is coupled to the barrel of the main spring through a reverser mechanism in order that the mass deliver kinetic energy for winding the spring regardless of the direction of rotation sense of said mass.

Among the most widespread types of reverser mechanisms may be considered those which for each direction of rotation of the oscillating mass comprises a ratchet wheel and a pawl loaded by a spring. The pawls and their associated springs are carried by a common winding wheel which is alternately coupled to the reducer winding gear train through respective pawls acting on the ratchet wheels.

Such an arrangement is described in Swiss Pat. No. 344.370. In this case, the winding wheel bears a pawl on each of its faces while the ratchet wheels are mounted on either side of this winding wheel on a common pivot axis. The pawls are hinged on the winding wheel by means of studs fixed in the latter. This patent however does not specify how the springs loading the pawls are arranged on the winding wheel.

In anoher known mechanism described in Swiss Pat. No. 348.922, there is provided a pawl bearing plate associated with a mounting ring coaxial with the plate but spaced apart from the latter. This pawl is mounted hinged on a pivot secured between the plate and the ring and cooperates with a spring anchored in the plate by means of a special stud provided for such anchoring.

The purpose of the present invention is to provide a reverser mechanism of the general type suggested hereinabove having a simplified construction so as to render the assembly thereof as simple as possible.

SUMMARY OF THE INVENTION

The invention thus has as principal object a reverser mechanism for automatic winding of a timepiece by an oscillating mass including a winding wheel coaxially mounted with two ratchet wheels arranged on either face of said winding wheel which bears on each of its faces at least one pawl loaded by a spring and cooperating respectively with one of the ratchet wheels, the assembly thus formed being inserted between the kinematic chain interposed between the oscillating mass and the mainspring barrel of the timepiece, the pawls assigned to the transmission of the rotation of said mass being articulately mounted respectively on pivot means fixed to said winding wheel, the pivot means being the pawl assigned to one of the directions of rotation of the mass serving at the same time as anchoring means for the spring which loads the pawl assigned to transmit the other direction of rotation of said mass.

There is thus obtained a reverser mechanism in which each pawl is commonly mounted with a spring which loads the other pawl on a single and common pivot means. There results therefrom not only a reduction in size but likewise a considerable simplification of the assembly.

The invention will be better understood from reading the description to follow given solely by way of example and having reference to the attached drawings.

DESCRIPTION OF THE PREFERRED EMBODIMENT

Figures 1, 4, 5, 6, 7:
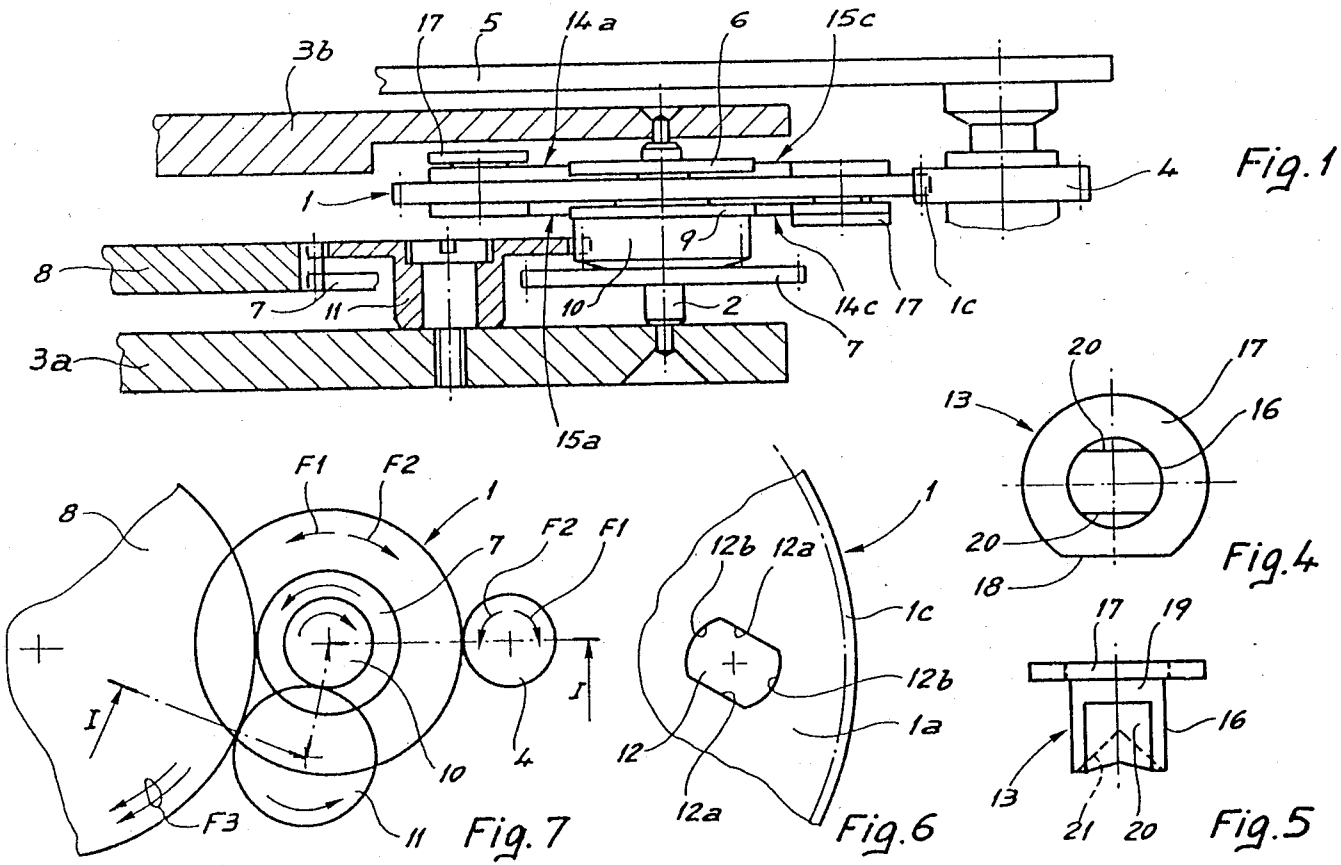
FIG. 1 is a cross-section and exterior view of a reverser mechanism according to the invention.
FIG. 4 is a plan view of one of the rivets employed for fastening a pawl and spring onto the winding wheel.
FIG. 5 is a side view of such rivet.
FIG. 6 is a partial view of the winding wheel without the elements which it bears and FIG. 7 is a schematic drawing illustrating the operation of the reverser mechanism according to the invention.

In referring to the drawings, it is seen that the winding wheel 1 of the reverser mechanism according to the invention includes a plate 1*a* and a bushing 1*b* which is freely engaged on a pivot axis 2. This latter is mounted for rotation between a bottom plate 3*a* and a bridge 3*b* of the timepiece. The plate 1a of the winding wheel 1 includes a crown 1*c* which meshes with the pinion 4 fixed in rotation to the oscillating mass 5.

Axis 2 forms a wheel set with a first ratchet wheel 6 and a transmission wheel 7 meshing with a wheel set 8 of a speed reducer train leading to the barrel (not shown) of the main spring of the timepiece in conformity with the arrangement well known to those skilled in the art.

A second ratchet wheel 9 arranged against the face of the plate 1*a* of the winding wheel 1 opposite to the first ratchet wheel 6 is wedged onto a transmission pinion 10 mounted for free rotation around the bushing 1*b* of the winding wheel 1.

Pinion 10 is in mesh with an intermediate wheel 11 meshing likewise with the wheel set 8 of the speed reducer train. It is to be noted that the cross-section of FIG. 1 corresponds to the broken line I—I shown on FIG. 7.

FIG. 6 shows that the plate 1*a* of winding wheel 1 is pierced with holes 12 situated respectively at 3, 6, 9 and 12 o'clock (FIG. 3), each hole being bounded by two opposed rectilinear edge portions 12*a* joined by two curved edge portions 12*b*.

Each of these holes 12 receives a rivet 13 serving for the mounting of the winding wheel 1 of an assembly formed respectively by pawls 14*a* to 14*d* and springs 15*a* to 15*d*.

Each rivet includes a stem 16 (FIGS. 4 and 5) provided at one of its ends with a flange 17, a peripheral segment of which is cut off and which thus provides a rectilinear edge 18.

A cylindrical portion of small height 19 on stem 16 situated proximate the flange 17 serves for the articulation of pawls 14*a* to 14*d* mounted on the rivet 13 under consideration.

The remainder of stem 16 exhibits two diametrally opposed flats 20 adjusted to the rectilinear edges 12*a* of holes 12 of the winding wheel 1.

It is seen that the embodiment described each ratchet wheel 6 and 9 cooperates with two respective pawls 14*a* 14*b* and 14*c*, 14*d* to which are associated springs 15*c*, 15*d* and 15*a*, 15*b* respectively, it being understood that the pawl (14*a* for instance) assigned to a given ratchet wheel (6 for instance) is articulated on rivet 13 which bears at the same time the spring (15*a* for instance) which loads the pawl (14*c* for instance) acting on the other ratchet wheel (9 for instance).

At the same time, it is not indispensable that two pawls act simultaneously on a same ratchet wheel. In a simplified version of the reverser mechanism according to the invention, one would provide only the assemblies pawl-spring 14*a*, 15*a* and 14*c*, 15*c* or indeed the assemblies pawl-spring 14*b*, 15*b* and 14*d*, 15*d*.

Figure 3:
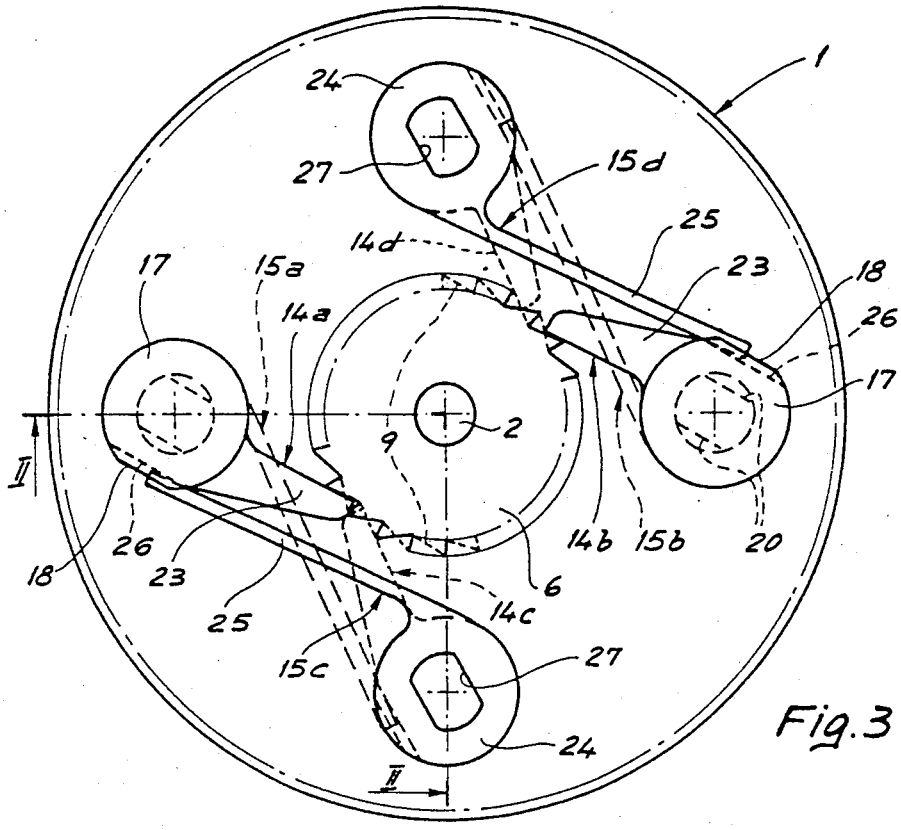
FIG. 3 is a plan view of the winding wheel showing the mounting of the pawls and the pawl springs.
Figure 2:
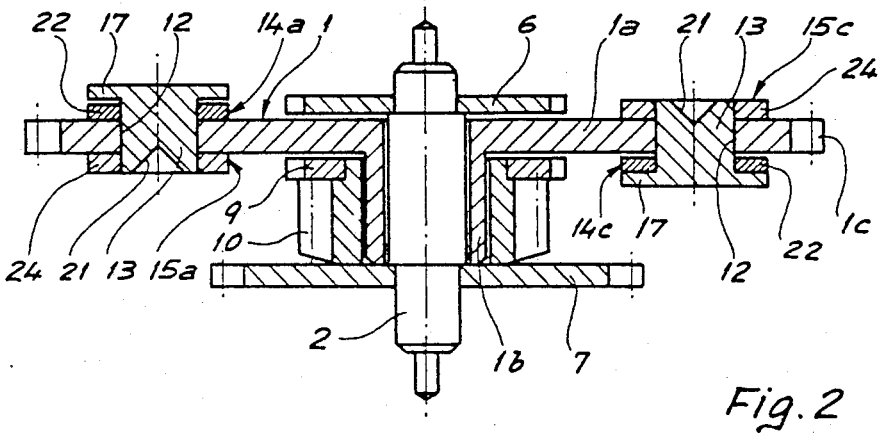
FIG. 2 is a cross-section view to a larger scale of the winding wheel and the associated elements incorporated in the mechanism according to the invention.

The advantage of the double arrangement seen on figure 3 consists in that one may displace the ends of the pawls acting on a common ratchet wheel by a half-tooth which reduces by half the minimum path of the oscillating mass required to obtain a winding action relative to the case in which a single pawl per ratchet wheel is provided.

However, whatever be the solution adopted, in view of the fact that each rivet receives a pawl and a spring, not only is the mechanism simplified, takes up less space and requires fewer machining operations and smaller pieces, but simplifies likewise the assembly of the mechanism.

The cut-out provided on the flange 17 of each rivet 13 in order to form edge 18 facilitates engagement of the elastic blade 25 below such flange and avoids too great a deformation during such operation.

The operation of the reverser mechanism appears on FIG. 7.

The oscillating mass 5 being moved in both directions, the winding wheel 1 follows it in these movements by displacing pawls 14*a* to 14*d*.

If the direction corresponds to the arrow F1 of figure 7, pawls 14*a* and 14*b* are engaged in the teeth of the ratchet wheel 6 while pawls 14*c* and 14*d* slip relative to ratchet wheel 9. Wheel 6 being coupled to wheel 7, wheel 8 is driven in the direction of arrows F3.

If, on the other hand, winding wheel 1 turns in the direction of arrow F2, pawls 14*c* and 14*d* are engaged in the teeth of ratchet wheel 9 while pawls 14*a* and 14*b* slip relative to ratchet wheel 6. Wheel 9 is wedged onto pinion 10 then drives wheel 8 in the direction of arrows F3 in view of the intermediate wheel 11.

Stem 16 of each rivet 13 includes at its free end a conical recess 21 which is coaxial with the rivet. In its mounted position each rivet 13 retains a pawl 14*a* to 14*d* between its flange 17 and the facing surface of plate 1*a*. Each pawl bears to this effect an articulation portion 22 being adjusted to the cylindrical portion 19 of the corresponding rivet. It includes likewise an active heel 23 which cooperates with the ratchet wheel 6 or 9 which is found situated on the same side of the plate 1*a*.

The end of each rivet opposite flange 17 projects beyond the plate 1*a* by a certain distance in order to receive the fastening portion 24 of a spring 15*a* to 15*d* from which extends an active elastic blade 25 cooperating with the conjugate pawl 14*a* to 14*d* which is located on the same surface of plate 1*a*. The free end of each active elastic blade 25 is supported against a rectilinear edge 26 provided on the articulation portion 22 of the pawl 14*a* to 14*d* with which it cooperates.

The fastening portion 24 of each spring 15*a* to 15*d* includes a hole 27 of the same form as the holes 12 in plate 1*a*. The springs are thus blocked from rotation on their corresponding rivet while they are likewise axially blocked thanks to a deformation towards the exterior of the end of the stem of each rivet, effected following mounting of each assembly on plate 1*a*. This deformation operation acts as riveting.

What I claim is:

1. A reverser mechanism for automatic winding of a timepiece by an oscillating mass which is able to rotate in a clockwise direction and a counterclockwise direction, said reverser mechanism comprising:

a winding wheel having two faces;

a first ratchet wheel and a second ratchet wheel, each arranged on a corresponding one of each faces and coaxially mounted with said winding wheel;

at least one pawl cooperating with the first ratchet wheel when said oscillating mass rotates in the clockwise direction, and at least one other pawl cooperating with the second ratchet wheel when said oscillating mass rotates in the counterclockwise direction, each of said pawls being loaded by a respective spring; and, a plurality of pivot means fixed to said winding wheel, each of said pawls being articulately mounted for pivoting on a corresponding one of said pivot means and cooperating with one of said ratchet wheels, and said corresponding pivot means also anchoring the spring loading the pawl cooperating with the other of said ratchet wheels.

2. The reverser mechanism as set forth in claim 1 wherein each of said pivot means is a rivet comprising a stem having one end provided with a flange and one other end, said stem passing through said winding wheel, the pawl mounted on said pivot means being axially. maintained by said flange against the corresponding face of said winding wheel, the spring anchored on said pivot means being held proximate each other end of said rivet, and said pawl and said spring being fixed to the winding wheel by permanent deformation of said other end of said rivet.

3. A reverser mechanism as set forth in claim 2 wherein the stem of each rivet includes a first cylindrical portion proximate said flange for the pivoting of the pawl and a second portion having at least one flat, said winding wheel has a hole for each rivet adapted to a cross-section of said second portion of the stem, and said spring includes a fastening portion pierced by a hole likewise adapted to said cross-section.

4. A reverser mechanism as set forth in claim 2 wherein the flange of said rivet includes a peripheral rectilinear portion for facilitating the engagement of said spring with the respective pawl loaded thereby during assembly of said reverser mechanism.

5. A reverser mechanism as set forth in claim 1 wherein each ratchet wheel is associated with two pawl assemblies, each assembly being formed by a spring and a pawl having a heel portion, said asseemblies being mounted on said winding wheel at angularly displaced positions such that the heel portions of the pawls are offset relative to one another by a half tooth of a toothing means of the associated ratchet wheel.

* * * * *

UNITED STATES PATENT AND TRADEMARK OFFICE

CERTIFICATE OF CORRECTION

PATENT NO. : 4,809,250

DATED : February 28, 1989

INVENTOR(S) : Willy Meier

It is certified that error appears in the above-identified patent and that said Letters Patent is hereby corrected as shown below:

Column 4, line 18, change "each" to --said--.

Column 4, line 34, change "The" to --A--.

Column 4, line 41, change "each" to --said--.

Signed and Sealed this

Twenty-fifth Day of July, 1989

*Attest:*

*Attesting Officer*

DONALD J. QUIGG

*Commissioner of Patents and Trademarks*